US010995977B2

(12) United States Patent
Ayyawar et al.

(10) Patent No.: US 10,995,977 B2
(45) Date of Patent: May 4, 2021

(54) MULLION HINGE ASSEMBLY

(71) Applicant: WHIRLPOOL CORPORATION, Benton Harbor, MI (US)

(72) Inventors: Kapil Ayyawar, St. Joseph, MI (US); Eric Larson, Arlington, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/553,815

(22) Filed: Aug. 28, 2019

(65) Prior Publication Data

US 2021/0063078 A1 Mar. 4, 2021

(51) Int. Cl.
*F25D 23/02* (2006.01)

(52) U.S. Cl.
CPC ..... *F25D 23/028* (2013.01); *F25D 2323/021* (2013.01); *F25D 2323/024* (2013.01)

(58) Field of Classification Search
CPC ..... F25D 23/028; F25D 2323/021; F25D 2323/024; F25D 2400/06
See application file for complete search history.

(56) References Cited

U.S. PATENT DOCUMENTS

| | | | | |
|---|---|---|---|---|
| 5,694,789 | A | 12/1997 | Do | |
| 7,008,032 | B2 | 3/2006 | Chekal et al. | |
| 7,543,897 | B2 | 6/2009 | Kim | |
| 8,167,389 | B2 | 5/2012 | Han et al. | |
| 8,876,233 | B2 * | 11/2014 | Laible | F25D 23/02 312/324 |
| 9,127,876 | B2 | 9/2015 | Wilson et al. | |
| 9,234,695 | B1 | 1/2016 | Dubina et al. | |
| 9,429,356 | B2 | 8/2016 | Kim et al. | |
| 9,448,004 | B2 | 9/2016 | Kim et al. | |
| 9,709,316 | B2 | 7/2017 | Miersen et al. | |
| 9,995,528 | B1 * | 6/2018 | Ebrom | F25D 29/00 |
| 2009/0273264 | A1 | 11/2009 | Butler | |
| 2012/0073321 | A1 | 3/2012 | Davis et al. | |

FOREIGN PATENT DOCUMENTS

| | | | | |
|---|---|---|---|---|
| JP | 2004301457 | A | 10/2004 | |
| KR | 20060094818 | A | 8/2006 | |
| KR | 1020130052087 | A * | 5/2013 | |
| WO | WO-2009109878 | A1 * | 9/2009 | F25D 23/028 |
| WO | WO-2012123035 | A1 * | 9/2012 | F25D 23/028 |
| WO | WO-2014173023 | A1 * | 10/2014 | F25D 23/02 |
| WO | 2017109648 | A1 | 6/2017 | |

* cited by examiner

*Primary Examiner* — Andrew M Roersma
(74) *Attorney, Agent, or Firm* — Price Heneveld LLP

(57) ABSTRACT

A hinge assembly for a mullion assembly includes a first hinge element having a first cam member with a cammed upper surface having a first portion and a second portion with an angled intermediate portion disposed therebetween. The first portion of the cammed upper surface of the first hinge element is vertically spaced-apart a distance from the second portion. A second hinge element is rotatably coupled to the first hinge element between first and second positions and includes a second cam member having a cammed lower surface that includes an engagement point that is engaged with the cammed upper surface of the first hinge element. The second hinge element is driven upwardly by the engagement of the engagement point and the cammed upper surface of the first hinge element as the second hinge element is rotated from the first position to the second position.

9 Claims, 5 Drawing Sheets

MULLION HINGE ASSEMBLY

BACKGROUND OF THE DISCLOSURE

The present disclosure generally relates to a mullion assembly, and more specifically, to a mullion assembly having a hinge assembly that biases the mullion assembly towards a stowed position on a refrigerator door to prevent the mullion assembly from inhibiting proper closure of the refrigerator door.

SUMMARY OF THE DISCLOSURE

According to one aspect of the present disclosure, a hinge assembly for a mullion assembly includes a first hinge element including a first cam member and a hinge pin. The first cam member includes a cammed upper surface spaced-apart from the hinge pin to define an interior cavity therebetween. The cammed upper surface includes a first portion disposed below a second portion with an ascending intermediate portion disposed therebetween. A second hinge element includes a second cam member, a base portion and a hollow interior portion. The second cam member includes a cammed lower surface that includes an engagement point that is engaged with the cammed upper surface of the first hinge element. The base portion of the second hinge element is slideably received in the interior cavity of the first hinge element. The hinge pin of the first hinge element is slideably received through the hollow interior portion of the second hinge element. The second hinge element is rotatable about the hinge pin between first and second positions. A spring member is operably coupled to the second hinge element and is operable between a first position and a second position. The spring member moves from the first position to the second position as the second hinge element rotates from the first position to the second position. The second position of the spring member defines a compressed condition of the spring member.

According to another aspect of the present disclosure, a refrigerator includes a door rotatably coupled to a cabinet between open and closed positions. A mullion assembly is pivotally coupled to the refrigerator door between stowed and deployed positions. The mullion assembly outwardly extends from an inside edge of the door when the mullion assembly is in the deployed position. A hinge assembly interconnects the mullion assembly with the door. The hinge assembly includes a first hinge element including a first cam member and a hinge pin. The first cam member includes a cammed upper surface including an upper portion disposed above a lower portion with an angled intermediate portion disposed therebetween. A second hinge element is rotatably received on the hinge pin between first and second positions and includes a second cam member. The second cam member includes a cammed lower surface that includes an engagement point that is engaged with the lower portion of the cammed upper surface of the first hinge element when the second hinge element is in the first position and the mullion assembly is in the stowed position. The engagement point is engaged with the upper portion of the cammed upper surface of the first hinge element when the second hinge element is in the second position and the mullion assembly is in the deployed position.

According to yet another aspect of the present disclosure, a hinge assembly for a mullion assembly includes a first hinge element having a first cam member with a cammed upper surface having a first portion and a second portion with an angled intermediate portion disposed therebetween.

The first portion of the cammed upper surface of the first hinge element is vertically spaced-apart a distance from the second portion. A second hinge element is rotatably coupled to the first hinge element between first and second positions and includes a second cam member having a cammed lower surface that includes an engagement point that is engaged with the cammed upper surface of the first hinge element. The second hinge element is driven upwardly by the engagement of the engagement point and the cammed upper surface of the first hinge element as the second hinge element is rotated from the first position to the second position.

These and other features, advantages, and objects of the present disclosure will be further understood and appreciated by those skilled in the art by reference to the following specification, claims, and appended drawings.

Figure 1:
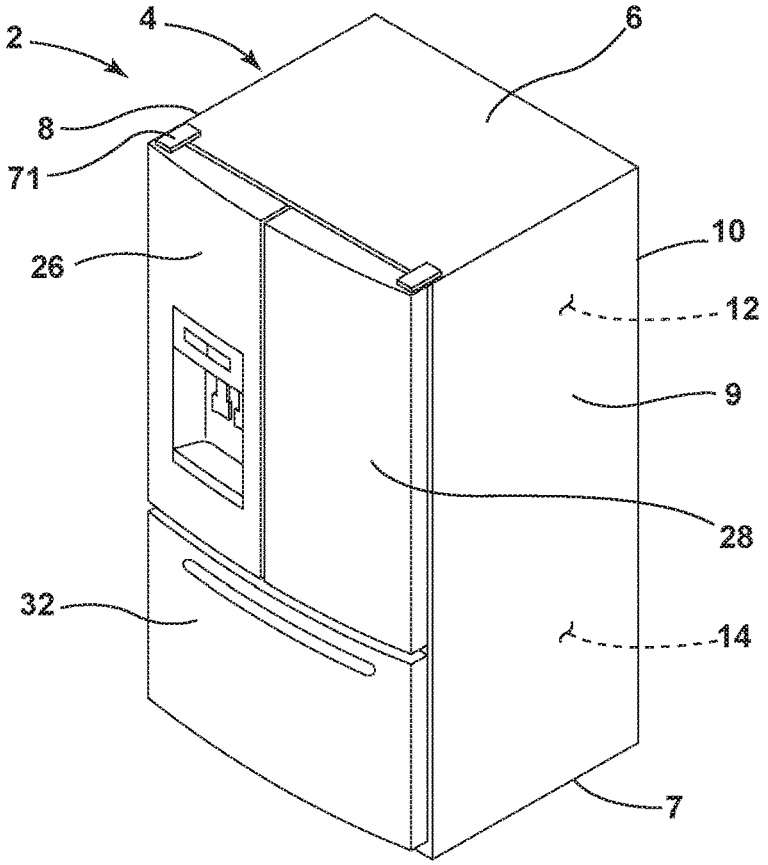
FIG. 1 is a top perspective view of a refrigerator.

The components in the figures are not necessarily to scale, emphasis instead being placed upon illustrating the principles described herein.

DETAILED DESCRIPTION

The present illustrated embodiments reside primarily in combinations of method steps and apparatus components related to a hinge assembly for a mullion assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIG. 1, reference numeral 2 general designates a bottom-mount refrigerator for use with the present concept. The refrigerator 2 includes a cabinet 4 having a top wall 6, a bottom wall 7, opposing sidewalls 8 and 9, and a rear wall 10 which cooperate to define first and second compartments 12 and 14. In the embodiment shown in FIG. 1, the first compartment 12 is disposed above the second compartment 14.

Figure 2:
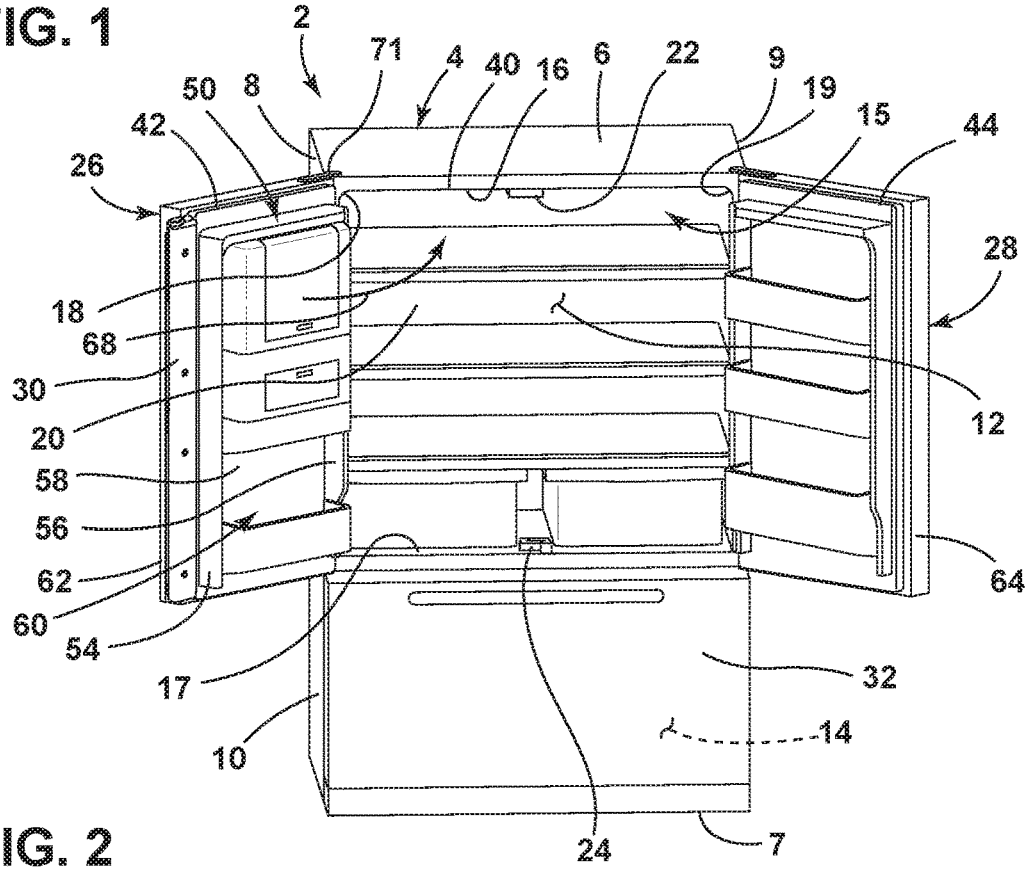
FIG. 2 is a top perspective view of the refrigerator of FIG. 1, with refrigerator doors shown in an open position.

Referring now to FIG. 2, the first compartment 12 includes a liner 15 having a top wall 16, a bottom wall 17, opposing sidewalls 18 and 19 and a rear wall 20. A first guide member 22 is shown disposed on a front portion of top wall 16 of the liner 15, and a second guide member 24 is shown disposed on a front portion of the bottom wall 17 of the liner 15. The first and second guide members 22, 24 define upper and lower guide members for guiding rotational movement of a mullion assembly as further described below.

Although not specifically identified, the refrigerator 2 is contemplated to include a refrigeration system for providing above and below freezing temperatures in compartments 12 and 14, respectively. Thus, in the embodiment of FIG. 1, it is contemplated that the first compartment 12 is a fresh food storage compartment, while the second compartment 14 is a freezer compartment. It is further contemplated that the open space configuration of the first compartment 12 may include various shelves, drawers and bins for dividing the open space and for storing items to be refrigerated in a manner known in the art. In FIG. 1, the second compartment 14 is selectively accessed via a door 32, which may be a sliding drawer-style door. Thus, the refrigerator 2 is a bottom mount refrigerator with lower freezer door 32 being adapted to slide in and out of the cabinet 4 to provide access to frozen items stored within second compartment 14.

As further shown in FIGS. 1 and 2, the refrigerator 2 includes a French-style door configuration having first and second doors 26 and 28. The first and second doors 26 and 28 are pivotally coupled to the cabinet 4 to selectively provide access to the first compartment 12. The first and second doors 26, 28 are adapted to seal against an open front portion 40 of the cabinet 4 in an air-tight manner to prevent cold air from escaping the first compartment 12. Specifically, the first and second doors 26, 28 seal against the open front portion 40 of the cabinet 4 via flexible gasket assemblies 42, 44, respectively, which may be elastomeric assemblies that may include sealing magnetic members disposed therein.

As specifically shown in FIG. 2, the first door 26 includes a door liner 50 having an outwardly projecting top portion 52, and outwardly projecting first and second side portions 54, 56 disposed on opposite sides of the top portion 52. A rear portion 58 interconnects the top portion 52 and the first and second side portions 54, 56 to collectively define a storage cavity 60. Within the storage cavity 60, it is contemplated that a variety of shelf members, i.e. adjustable shelves, bins, storage units and the like, can be positioned within the storage cavity 60 as supported between the opposing side portions 54, 56.

Except as otherwise identified below, the structure of each of the first and second doors 26, 28 is substantially identical, however, reversed in configuration as known in the art. As further shown in FIG. 1, the first and second doors 26, 28 include inside edges 62, 64, respectively, which are configured to seal against a mullion assembly 30 when the first and second doors 26, 28 are in a closed position (FIG. 1). The mullion assembly 30 is a flipper mullion shown in an inwardly rotated or stowed position in FIG. 2. Movement of the mullion assembly 30 is contemplated to be a pivoting movement provided via one or more hinge assemblies interconnecting the mullion assembly 30 with the first side portion 54 of the liner 50 of the first door 26. Movement of the mullion assembly 30 between stowed and deployed positions is generally guided by the first and second guide members 22, 24 interacting, respectively, with the upper and lower portions of the mullion assembly 30 as the first door 26 moves to the open position (FIG. 2) from a closed position (FIG. 1), and vice versa. While the mullion assembly 30 is shown coupled to the liner 50 of the first door 26, it is also contemplated that the mullion assembly 30 can be pivotally mounted to a component part of the second door 28, such that the present concept is not limited to a specific right or left door mounting configuration for the mullion assembly 30. In the embodiment shown in FIG. 2, the first and second doors 26, 28 are shown in fully open positions relative to the cabinet 4 of the refrigerator 2.

Figure 3:
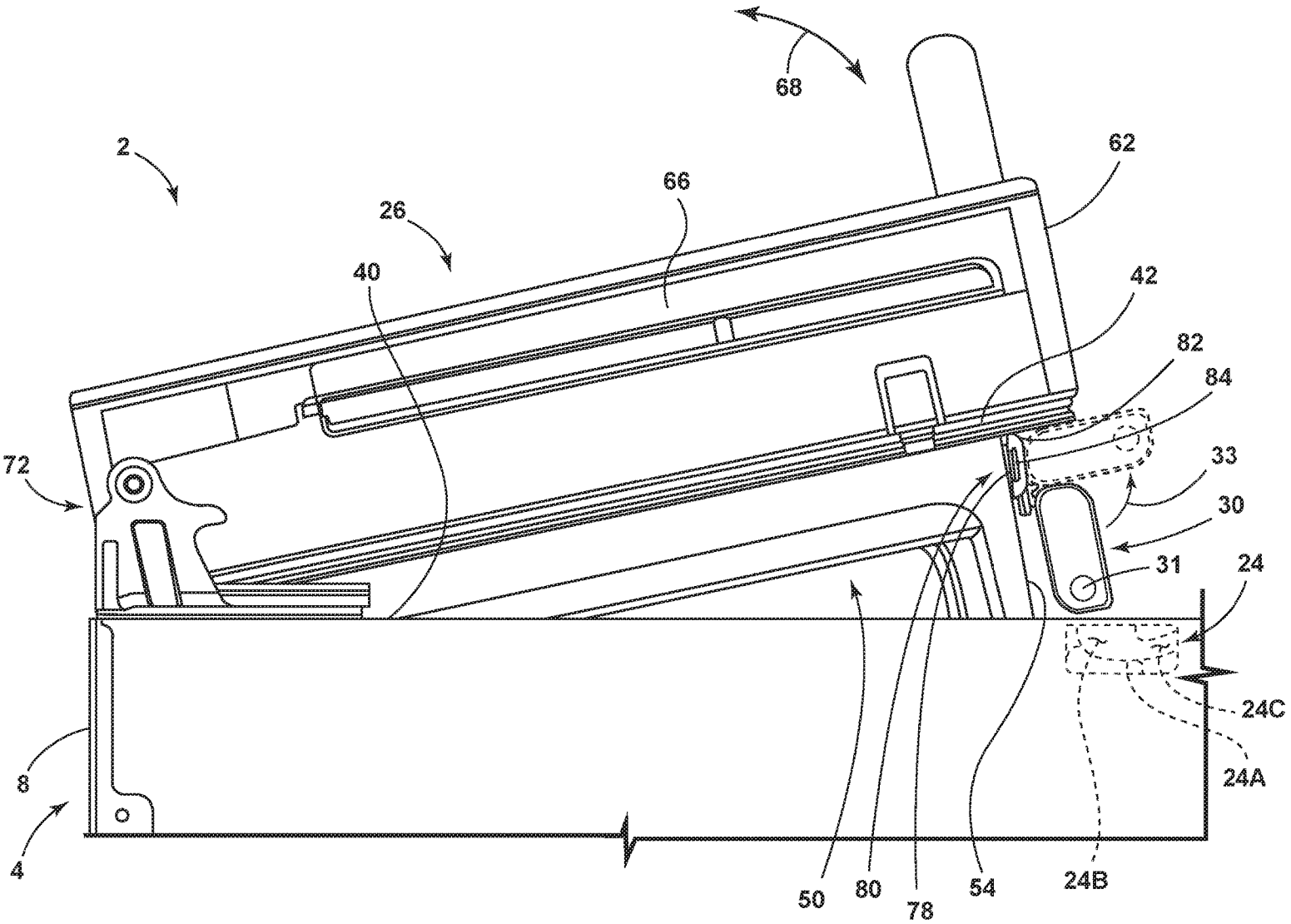
FIG. 3 is a bottom perspective view of the refrigerator of FIG. 1 showing a refrigerator door in a partially open position with the mullion assembly in a stowed position, wherein a deployed position of the mullion assembly is shown in phantom.

Referring now to FIG. 3, a fragmentary view of an underside 66 of the refrigerator 2 is shown with the door 26 in a partially open position. The door 26 is pivotally mounted to the cabinet 4 by an upper hinge assembly 71, as shown in FIGS. 1 and 2. The door 26 is further pivotally mounted to the cabinet 4 by a lower hinge assembly 72 coupled to the underside 66 of the door 26, as shown in FIG. 3. In this way, the door 26 is configured for pivoting movement along a swing path of the door 26 as indicated by arrow 68 (FIGS. 2 and 3) between open and closed positions relative to the cabinet 4.

As further shown in FIG. 3, the mullion assembly 30 includes a guide pin 31 disposed on an underside of the mullion assembly 30. The guide pin 31 is configured to engage the lower guide member 24 of the storage compartment 12 to rotate the mullion assembly 30 along a rotational path 33 from the stowed position of FIG. 3 to a deployed position shown in phantom in FIG. 3. It is further contemplated that the door 26 may include an upper guide pin for engagement with the upper guide member 22 to further guide movement of the mullion assembly 30. As the door 26 moves closer to the closed position along the swing path 68 of the door 26, the guide pin 31 disposed on the underside of the mullion assembly 30 will engage the lower guide member 24 of the storage compartment 12. Specifically, the guide pin 31 will engage a guide path 24A of the lower guide member 24 at a first portion 24B thereof. The guide path 24A of the lower guide member 24 defines a channel through the lower guide member 24 that the guide pin 31 of the mullion assembly 30 follows to move the mullion assembly 30 from the stowed position to the deployed position when closing the door 26. The guide path 24A includes first and second portions 24B, 24C. The guide pin 31 of the mullion assembly enters the guide path 24A at the first portion 24B of the guide path 24A when initially making contact with the lower guide member 24 during a door closing movement. With this physical engagement, the mullion assembly 30 begins rotation from the stowed position to the deployed position. The mullion assembly 30 is then fully rotated to the deployed position as the door 26 moves to the fully closed position. When the door 26 is in the fully closed position, the guide pin 31 is disposed in the second portion 24C of the guide path 24A of the guide member 24, such that the mullion assembly 30 is in the deployed position.

Movement of the mullion assembly 30 from the stowed position to the deployed position is provided via a mullion hinge assembly 80 that interconnects the mullion assembly 30 with the door 26 in a rotatable manner. Specifically, the mullion assembly 30 is coupled to the door 26 at the outwardly extending side portion 54 of the liner 50 of the door 26. Thus, the mullion assembly 30 outwardly extends from the inside edge 62 of the door 26 when the mullion assembly 30 is in the deployed position to cover a gap between the doors 26, 28 of the refrigerator 2 when the doors 26, 28 are closed. Other mounting locations for the mullion assembly 30 are also contemplated for use with the present concept. The mullion hinge assembly 80 may be one of multiple mullion hinge assemblies that pivotally couple the mullion assembly 30 to the door 26. As shown in FIG. 3, the door 26 includes a clip member 78, which may be a dove-tailed clip member, that is received in a channel 84 of a base portion 82 of the mullion hinge assembly 80, to fixedly coupled the mullion hinge assembly to the door 26 and thereby pivotally couple the mullion assembly 30 to the door 26.

Figure 4:
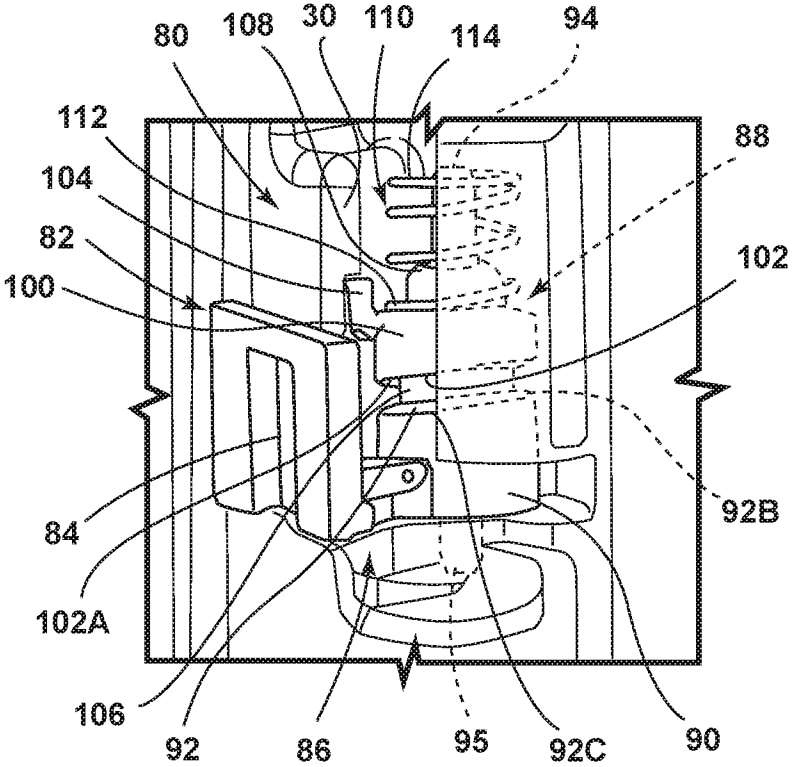
FIG. 4 is a top perspective view of a hinge assembly with first and second hinge element, wherein the second hinge element is shown in a first position.
Figure 6:
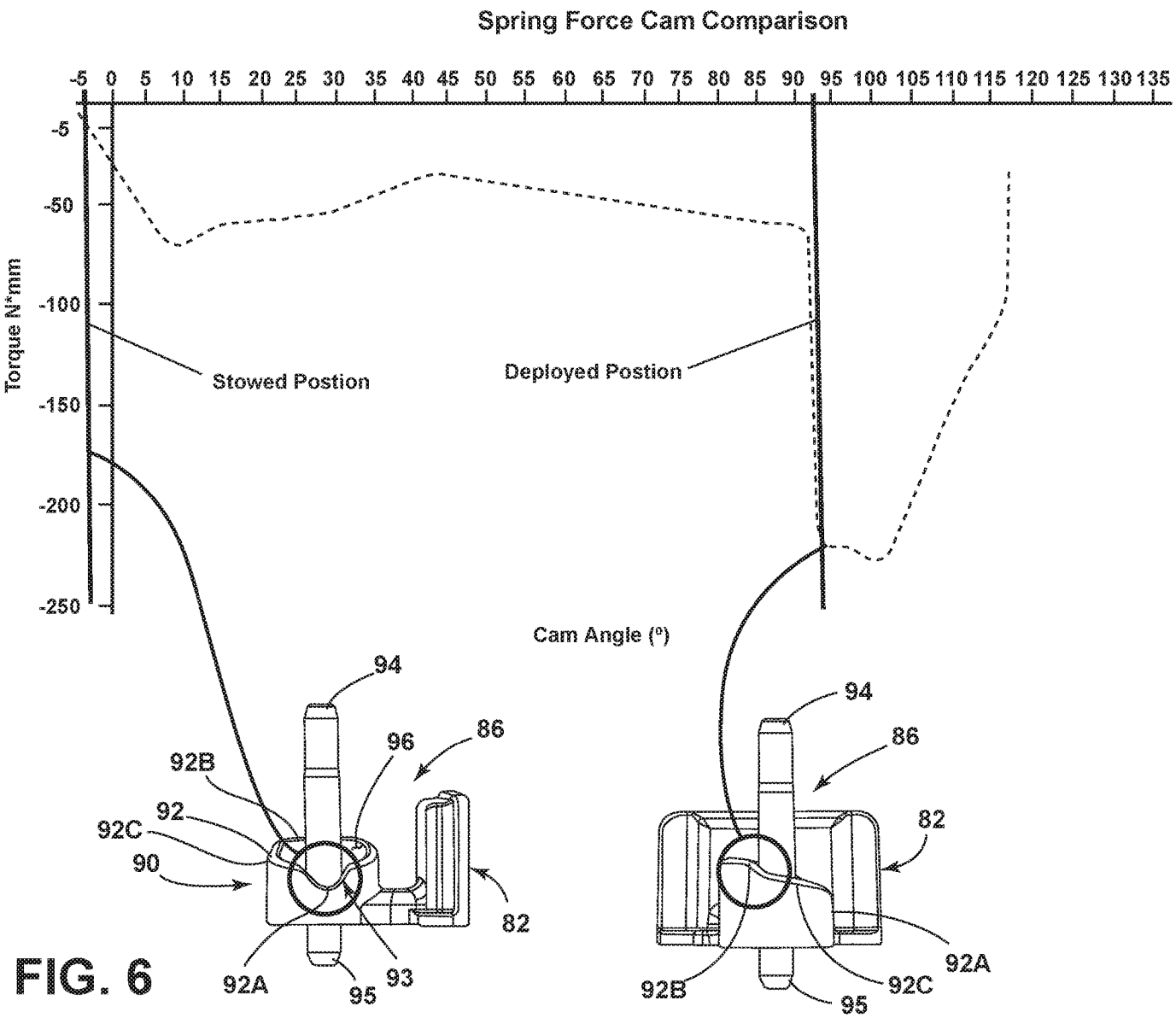
FIG. 6 is a graphical representation of a mullion assembly angle relative to an imparted spring force with representations of the first hinge element of FIG. 4.

Referring now to FIG. 4, the hinge assembly 80 includes a first hinge element 86 which includes a first cam member 90. The first cam member 90 is spaced-apart from the base portion 82 of the mullion hinge assembly 80 and includes cammed upper surface 92. In the embodiment shown, a hinge pin 94 projects upwardly from the first cam member 90 and is spaced-apart from the cam member 90 to define an interior cavity 96 therebetween, as best shown in FIG. 6. A lower hinge pin 95 projects downwardly from the first cam member 90 and can be used to pivotally engage a portion of the mullion assembly 30.

As further shown in FIG. 4, mullion hinge assembly 80 includes a second hinge element 88 which includes a second cam member 100 and a mounting flange 104 adapted to interconnect with mullion assembly 30. The second cam member 100 includes a cammed lower surface 102 that is configured to engage the cammed upper surface 92 of the first cam member 90 in assembly. Specifically, the cammed lower surface 102 includes an engagement point 102A that remains in contact with the cammed upper surface 92 of the first cam member 90 as the second cam member 100 rotates relative to the first cam member 90. The engagement point 102A of the cammed lower surface 102 of the second cam member 100 defines a lowermost point of the cammed lower surface 102 of the second cam member 100. The second hinge element 88 further includes a base portion 106 that is rotatably received in the interior cavity 96 of first hinge element 86. The base portion 106 is also slideably received within the interior cavity 96 of the first hinge element 86 for vertical movement therein. This engagement allows for the base portion 106 of the second hinge element 88 to nest within the interior cavity 96 of the first hinge element 86. The second hinge element 88 further includes a receiving channel 108 disposed therethrough. The receiving channel 108 of the second hinge element 88 defines a hollow interior portion for the second hinge element 88. In assembly, the hinge pin 94 of the first hinge element 86 extends through the receiving channel 108 to further interconnect the first and second hinge elements 86, 88. This interconnection about the hinge pin 94 enables the first and second cam members 90, 100 to pivot relative to one another, as further described below.

In the embodiment shown in FIG. 4, the second hinge element 88 is positioned on the first hinge element 86 in a first position. As noted above, the second hinge element 88 is rotatably received on the hinge pin 94 of the first hinge element 86. Thus, the second hinge element 88 can rotate from the first position shown in FIG. 4, to a second position shown in FIG. 5. The rotation of the second hinge element 88 relative to the first hinge element 86 is provided as the mullion assembly 30 rotates along the door 26. When the second hinge element 88 is in the first position (FIG. 4), the mullion assembly 30 is contemplated to be in the stowed position. When the second hinge element 88 is in the second position (FIG. 5), the mullion assembly 30 is contemplated to be in the deployed position.

As further shown in FIG. 4, the mullion hinge assembly 80 includes a spring member 110 having a first end 112 abutting the second hinge element 88, and a second end 114 abutting a portion of the mullion assembly 30. The spring member 110 is shown in the form of a coil spring in FIG. 4 and is positioned above second hinge element 88. In use, the spring member 110 provides a biasing force that acts on the second hinge element 88 to hold the cammed lower surface 102 of the second hinge element 88 against the cammed upper surface 92 of the first hinge element 86. Thus, the second hinge element 88 is fixedly mounted to the mullion assembly 30 via mounting flange 104, but is also slideably disposed on the first hinge element 86 for vertical movement along the hinge pin 94 of the first hinge element 86. In FIG. 4, the first and second hinge elements 86, 88 are aligned in that the respective cammed surfaces 92, 102 are disposed at like angles relative to one another. Thus, in FIG. 4, it is contemplated that the mullion assembly 30 is in a stowed position, as shown in FIG. 3. The mullion assembly 30 is biased to this position by the interaction of the cammed surfaces 92, 102 as held in contact by the spring member 110.

As noted above, the mullion assembly 30 is configured to rotate about the mullion hinge assembly 80 (and other such hinge assemblies) between deployed and stowed positions. When the door 26 is in an open position, the mullion assembly 30 is contemplated to be in the stowed position. Further, when the door 26 is in the open position, the mullion assembly 30 is accessible to a user and susceptible to rotation from the stowed position to the deployed position by a user. Rotation of the mullion assembly 30 from the stowed position to the deployed position when the door 26 is in the open position can be problematic as a user may attempt to close the door 26 when the mullion assembly, in the deployed position, is not properly configured to engage the cabinet 4. With the mullion assembly 30 extending outwardly from the door 26 in the deployed position during a closing movement of the door 26, the mullion assembly 30 could be broken or damaged when brought into contact with a closed door assembly (such as second door 28), or, if both refrigerator doors 26, 28 are opened, a guide pin of the mullion assembly 30 could be damaged by a broadside engagement with a body portion of one of the upper or lower guide members 22, 24. At a minimum, the door 26 will not be able to fully close if a user were to close the door 26 with the mullion assembly 30 in the deployed position. Thus, the mullion hinge assembly 80 is configured to bias the mullion assembly 30 to the stowed position to counteract undesired interference by a user.

Figure 5:
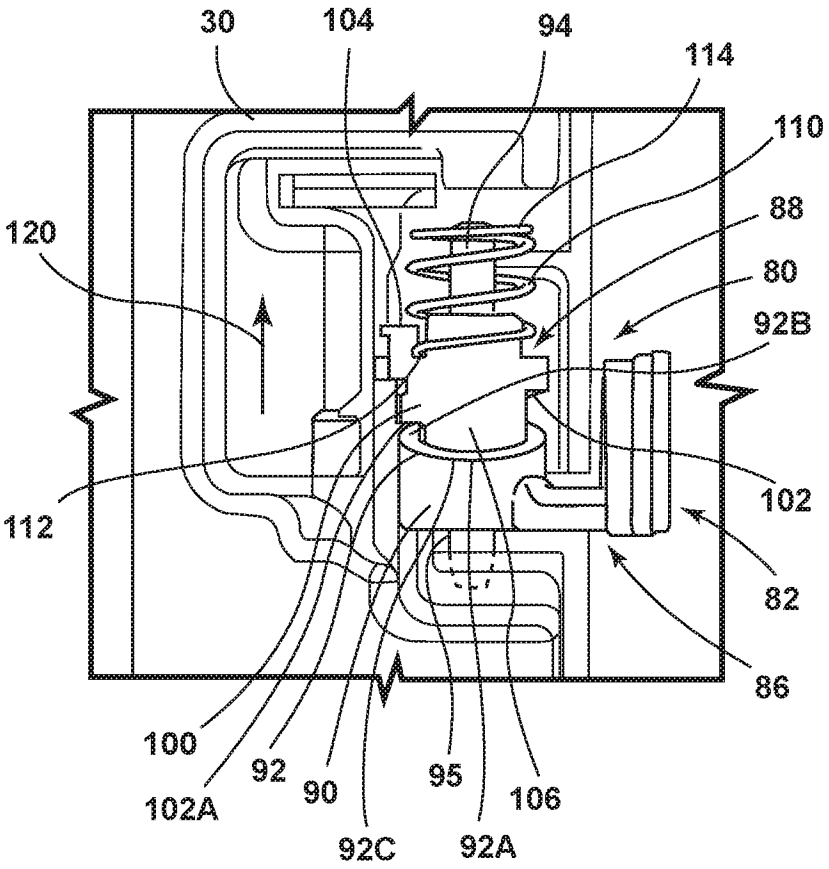
FIG. 5 is a side elevation view of the hinge assembly of FIG. 4 with the second hinge element shown in a second position.

When the mullion assembly 30 moves from the deployed position to the stowed position, the cammed surfaces 92, 102 are disposed at like angles relative to one another, such that the first and second cam members 90, 100 are said to be aligned (as shown in FIG. 4). This alignment helps to retain the mullion assembly 30 in the stowed position while the door 26 is opened. When the mullion assembly 30 is moved to the deployed position from the stowed position while the door 26 is in the open position, the cammed lower surface 102 of the second cam member 100 rotates with the mullion assembly 30, such that the engagement point 102A of the cammed lower surface 102 of the second cam member 100 rides the cammed upper surface 92 of the first cam member 90. This rotation of the second cam member 100 drives the second cam member 100 upward in the direction as indicted by arrow 120 in FIG. 5, such that the second hinge element 88 is vertically displaced from the first hinge element 86. The upward movement of the second cam member 100 compresses the spring member 110 to increase a force between the cammed surfaces 92, 102 as the cammed surfaces 92, 102 are misaligned with one another, as shown in FIG. 5, when the mullion assembly 30 is in the deployed position. This force urges the cammed surfaces 92, 102 back towards the at-rest position or aligned position shown in FIG. 4, wherein the cammed surfaces 92, 102 are aligned with one another. Thus, the spring member 110 of the present concept is operable between first and second positions, wherein the first position may correlate to an at-rest condition of the spring member 110, while the second position of the spring member 110 may correlate to a compressed condition of the spring member 110. Vertical displacement or compression of the spring member 110 between the at-rest condition and the compressed condition is contemplated to be commensurate with the distance 122 (FIG. 7) between vertically offset portions of the cammed upper surface 92 of the first hinge element 86, as further described below.

Figure 7:
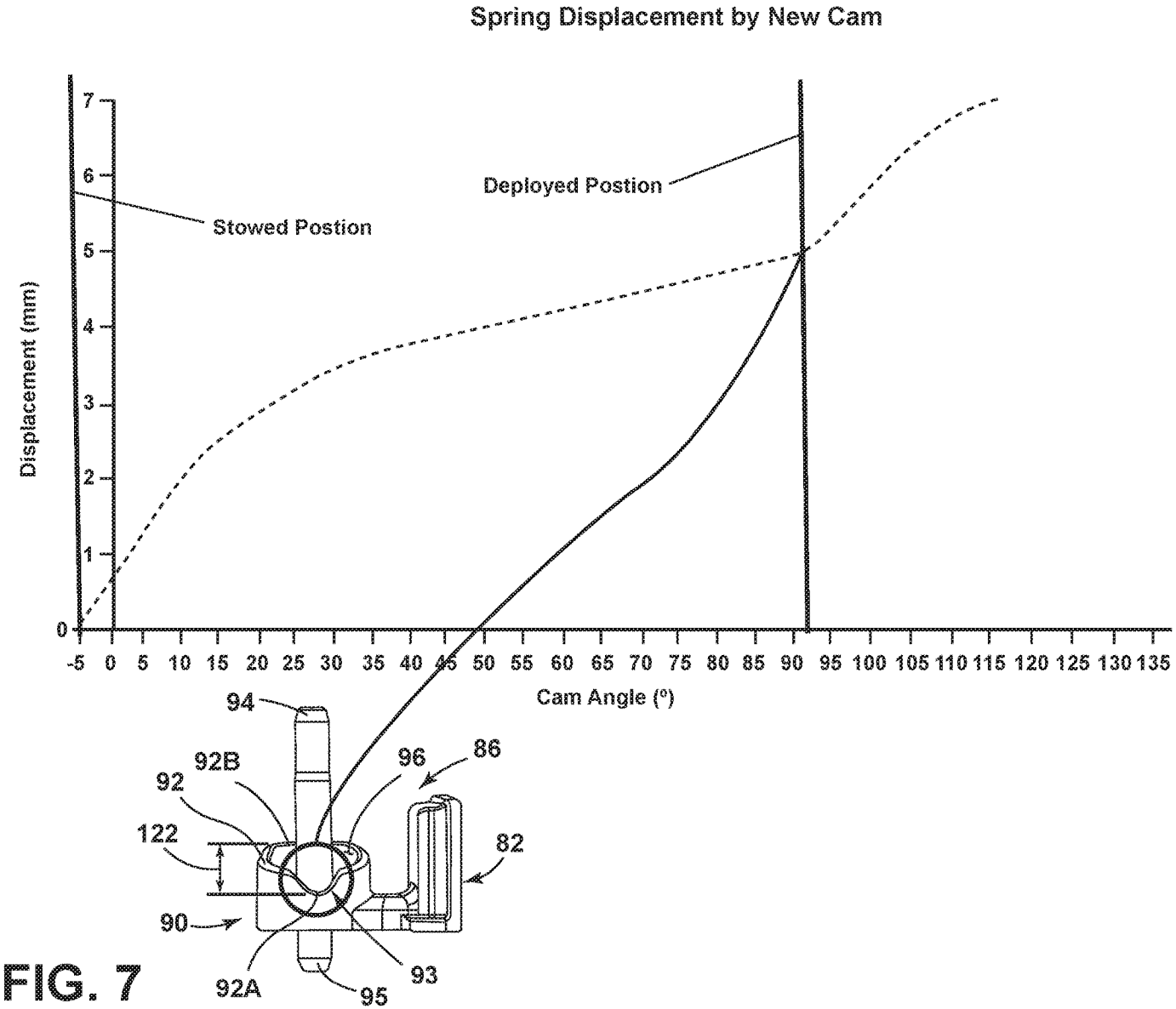
FIG. 7 is a graphical representation a mullion assembly angle relative to a compression of a spring member with a representation of the first hinge element of FIG. 4.

Referring now to FIG. 6, the cammed upper surface 92 of the first hinge element 86 includes a first portion 92A that is defined at a low position within a crenulation 93 of the cammed upper surface 92. The cammed upper surface 92 of the first hinge element 86 further includes a second portion 92B that is defined at a high position along the cammed upper surface 92. The second portion 92B of the cammed upper surface 92 does not need to be the highest portion of the cammed upper surface 92, but is disposed above first portion 92A. Thus, the first portion 92A and the second portion 92B of the cammed upper surface 92 define lower and upper portions, respectively, that are vertically offset from one another a distance 122 (FIG. 7). The cammed upper surface 92 includes an intermediate portion 92C that is an angled portion disposed in a continuous decline configuration from the second portion 92B of the cammed upper surface 92 to the first portion 92A of the cammed upper surface 92. Thus, with the second portion 92B disposed vertically above the first portion 92A, the angled intermediate portion 92C disposed therebetween provides a continuously progressive translation between the first and second portions 92A, 92B of the cammed upper surface 92 of the first hinge element 86. Thus, the intermediate portion 92C can be said to be an ascending intermediate portion as translating from the first portion 92A to the second portion 92B. Further, the intermediate portion 92C can be said to be a descending intermediate portion as translating from the second portion 92B to the first portion 92A.

Further, there is no crenulation at the second portion 92B of the cammed upper surface 92, such that the engagement of the engagement point 102A of the second hinge element 88 at the second portion 92B of the cammed upper surface 92 of the first hinge element 86 is considered the misaligned engagement of the first and second hinge elements 86, 88. Thus, when the engagement point 102A is in contact with the second portion 92B of the cammed upper surface 92 of the first hinge element 86, the second hinge element 88 is biased towards a rotated position, wherein the engagement point 102A is in contact with the first portion 92A of the cammed upper surface 92 of the first hinge element 86. It is contemplated that the engagement point 102A can downwardly extend to nest within the crenulation 93 to retain the engagement point 102A of the second hinge element 88 in contact with the second portion 92B of the cammed upper surface 92 of the first hinge element 86. In this way, the crenulation 93 of the cammed upper surface 92 of the first hinge element 86 defines a detent location for receiving the engagement point 102A of the cammed lower surface 102 of the second hinge element 88.

As noted above, movement of the engagement point 102A of the second hinge element 88 along the ascending cammed upper surface 92 of the first hinge element 86 moves the second hinge element 88 upward along hinge pin 94 and loads the spring member 110 to further bias the second hinge element 88 back to the interconnection between the engagement point 102A and the second portion 92B of the cammed upper surface 92 of the first hinge element 86. As further noted above, when the engagement point 102A of the second hinge element 88 is in contact with the second portion 92B of the cammed upper surface 92 of the first hinge element 86, the mullion assembly 30 is rotated towards the deployed position, which is approximately 90° relative to the first side portion 54 of the door liner 50, as shown in phantom in FIG. 3. When the engagement point 102A of the second hinge element 88 is in contact with the first portion 92A of the cammed upper surface 92 of the first hinge element 86, the mullion assembly 30 is in the stowed position, and is approximately parallel with the first side portion 54 of the door liner 50, as shown in phantom in FIG. 3. Thus, the hinge assembly 80 of the present concept biases the mullion assembly 30 towards the stowed position by the engagement of the cammed surfaces 92, 102 and the urging bias provided by the spring member 110. Thus, in the misaligned position (i.e. when the engagement point 102A of the second hinge element 88 is in contact with the second portion 92B of the cammed upper surface 92 of the first hinge element 86), the second hinge element will be biased to rotate towards the aligned position (i.e. when the engagement point 102A of the second hinge element 88 is in contact with the first portion 92A of the cammed upper surface 92 of the first hinge element 86). This rotational movement will gravitationally occur as the engagement point 102A moves downwardly along the descending intermediate portion 92C of the cammed upper surface 92 of the first hinge element 86 which continuously translates from the second portion 92B to the first portion 92A, and is aided by the downward force of the spring member 110.

Referring now to FIG. 6, a graphical representation is shown depicting a spring force comparison of the spring member 110 when the engagement point 102A of the second hinge element 88 is disposed at the first and second positions 92A, 92B along the cammed upper surface 92 of the first hinge element 86. Thus, at the −5° location along the chart of FIG. 6, the mullion assembly 30 is contemplated to be in the stowed position, as shown in FIG. 3, and the spring member is contemplated to have little to no torque acting on the second hinge element 88. With the mullion assembly 30 and the stowed position, the engagement point 102A of the second hinge element 88 is contemplated to be disposed at the first portion 92A within the crenulation 93 of the cammed upper surface 92 of the first hinge element 86 as specifically identified in the left-hand depiction of the first hinge element 86 of FIG. 6. As the mullion assembly 30 rotates from the stowed position towards the deployed position, the engagement point 102A of the second hinge element 88 is contemplated to move from the first portion 92A within the crenulation 93 of the cammed upper surface 92 of the first hinge element 86 towards the second portion 92B of the cammed upper surface 92 of the first hinge element 86 as specifically identified in the right-hand depiction of the first hinge element 86 of FIG. 6. With the engagement point 102A of the second hinge element 88 engaged with the second portion 92B of the cammed upper surface 92 of the first hinge element 86, the torque on the spring member 110 has risen considerably to the tune of approximately 200N*mm. This amount of torque provided by the spring member 110 correlates to the mullion assembly 30 being disposed approximately 90° or more from the door 26 (as shown in FIG. 3). Thus, the spring member 110 compresses as the second hinge element 88 moves upward along the hinge pin 94 of the first hinge element 86 during the rotation of the second hinge element 88 relative to the first hinge element 86. As noted above, the second hinge element 88 moves upward along the hinge pin 94 of the first hinge element 86 during rotation of the second hinge element 88, as the engagement point 102A rides along the ascending intermediate portion 92C of the cammed upper surface 92 of the first hinge element 86 between the first and second portions 92A, 92B of the cammed upper surface 92. This vertically displaces the second hinge element 88 relative to the first hinge element 86 by simultaneously turning and raising the second hinge element 88. Raising the second hinge element 88 vertically compresses the spring member 110. In the compressed condition, the spring member 110 provides a considerable downward force on the second hinge element 88 to urge the second hinge element 88 into alignment with the first hinge element 86. The aligned position is the position in which the engagement point 102A of the second hinge member 88 is aligned with the first portion 92A of the cammed upper surface 92 of the first hinge element 86, which is also the position that correlates to the mullion assembly 30 being in the stowed position shown in FIG. 3.

Referring now to FIG. 7, the vertical displacement between the first portion 92A and the second portion 92B is contemplated to be over 5 mm and can be anywhere within a range from about 4.5 mm to about 5.5 mm. Thus, as the second hinge element 88 moves upward along the hinge pin 94 of the first hinge element 86 during the rotation of the second hinge element 88 relative to the first hinge element 86, the spring member 110 can compress a distance of approximately 4.5 mm to about 5.5 mm. Thus, in FIG. 7, the rotation of the mullion assembly 30 is shown from −5° (the stowed position) to 90° (the deployed position) relative to the door 26, which correlates to a displacement or compression of the spring member 110 a distance commensurate with the vertical distance 122 between the first and second portions 92A, 92B of the cammed upper surface 92 of the first hinge element 86.

According to one aspect of the present disclosure, a hinge assembly for a mullion assembly includes a first hinge element including a first cam member and a hinge pin. The first cam member includes a cammed upper surface spaced-apart from the hinge pin to define an interior cavity therebetween. The cammed upper surface includes a first portion disposed below a second portion with an ascending intermediate portion disposed therebetween. A second hinge element includes a second cam member, a base portion and a hollow interior portion. The second cam member includes a cammed lower surface that includes an engagement point that is engaged with the cammed upper surface of the first hinge element. The base portion of the second hinge element is slideably received in the interior cavity of the first hinge element. The hinge pin of the first hinge element is slideably received through the hollow interior portion of the second hinge element. The second hinge element is rotatable about the hinge pin between first and second positions. A spring member is operably coupled to the second hinge element and is operable between a first position and a second position. The spring member moves from the first position to the second position as the second hinge element rotates from the first position to the second position. The second position of the spring member defines a compressed condition of the spring member.

According to another aspect of the present disclosure, the engagement point of the second hinge element defines a lowermost point of the cammed lower surface.

According to another aspect of the present disclosure, the engagement point of the second hinge element is engaged with the first portion of the cammed upper surface of the first hinge element when the second hinge element is in the first position.

According to another aspect of the present disclosure, the engagement point of the second hinge element is engaged with the second portion of the cammed upper surface of the first hinge element when the second hinge element is in the second position.

According to another aspect of the present disclosure, the second hinge element moves upward along the hinge pin of the first hinge element as the second hinge element rotates from the first position to the second position.

According to another aspect of the present disclosure, the spring member biases the second hinge element downward along the hinge pin of the first hinge element to urge the second hinge element to rotate from the second position towards the first position.

According to another aspect of the present disclosure, the ascending intermediate portion of the cammed upper surface of the first hinge element is continuously ascending from the first portion to the second portion of the cammed upper surface of the first hinge element.

According to yet another aspect of the present disclosure, the first portion of the cammed upper surface of the first hinge element is disposed within a crenulation defined on the cammed upper surface of the first hinge element.

According to another aspect of the present disclosure, a refrigerator includes a door rotatably coupled to a cabinet between open and closed positions. A mullion assembly is pivotally coupled to the refrigerator door between stowed and deployed positions. The mullion assembly outwardly extends from an inside edge of the door when the mullion assembly is in the deployed position. A hinge assembly interconnects the mullion assembly with the door. The hinge assembly includes a first hinge element including a first cam member and a hinge pin. The first cam member includes a cammed upper surface including an upper portion disposed above a lower portion with an angled intermediate portion disposed therebetween. A second hinge element is rotatably received on the hinge pin between first and second positions and includes a second cam member. The second cam member includes a cammed lower surface that includes an engagement point that is engaged with the lower portion of the cammed upper surface of the first hinge element when the second hinge element is in the first position and the mullion assembly is in the stowed position. The engagement point is engaged with the upper portion of the cammed upper surface of the first hinge element when the second hinge element is in the second position and the mullion assembly is in the deployed position.

According to another aspect of the present disclosure, a spring member operably coupled between the second hinge element and the mullion assembly, wherein the spring member biases the mullion assembly towards the stowed position from the deployed position.

According to another aspect of the present disclosure, a spring member operably coupled between the second hinge element and the mullion assembly, wherein the spring member biases the second hinge element towards the first position from the second position.

According to another aspect of the present disclosure, the engagement point of the second hinge element defines a lowermost point of the cammed lower surface.

According to another aspect of the present disclosure, the second hinge element moves upward along the hinge pin of the first hinge element as the second hinge element rotates from the first position to the second position.

According to another aspect of the present disclosure, the angled intermediate portion of the cammed upper surface of the first hinge element is continuously angled in an upward direction from the lower portion of the cammed upper surface of the first hinge element to the upper portion of the cammed upper surface of the first hinge element.

According to another aspect of the present disclosure, the first portion of the cammed upper surface of the first hinge element is disposed within a crenulation defined on the cammed upper surface of the first hinge element.

According to another aspect of the present disclosure, the second hinge element includes a mounting flange to fixedly couple the second hinge element to the mullion assembly for rotation therewith.

According to yet another aspect of the present disclosure, the first hinge element includes a base portion to fixedly couple the first hinge element to the door, and further wherein the base portion is spaced-apart from the first cam member.

According to yet another aspect of the present disclosure, a hinge assembly for a mullion assembly includes a first hinge element having a first cam member with a cammed upper surface having a first portion and a second portion with an angled intermediate portion disposed therebetween. The first portion of the cammed upper surface of the first hinge element is vertically spaced-apart a distance from the second portion. A second hinge element is rotatably coupled to the first hinge element between first and second positions and includes a second cam member having a cammed lower surface that includes an engagement point that is engaged with the cammed upper surface of the first hinge element. The second hinge element is driven upwardly by the engagement of the engagement point and the cammed upper surface of the first hinge element as the second hinge element is rotated from the first position to the second position.

According to another aspect of the present disclosure, the first portion of the cammed upper surface of the first hinge element is disposed below the second portion of the cammed upper surface of the first hinge element.

According to another aspect of the present disclosure, the distance between the first portion of the cammed upper surface of the first hinge element and the second portion of the cammed upper surface of the first hinge element is in a range from about 4.5 mm to about 5.5 mm.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator, comprising:

a door rotatably coupled to a cabinet between open and closed positions;

a mullion assembly pivotally coupled to the door between stowed and deployed positions, wherein the mullion assembly outwardly extends at a substantially right angle from an inside edge of the door when the mullion assembly is in the deployed position, and further wherein the mullion assembly is substantially parallel to the inside edge of the door when the mullion assembly is in the stowed position;

a hinge assembly interconnecting the mullion assembly with the door, wherein the hinge assembly includes:

a first hinge element having a first cam member and a hinge pin, wherein the first cam member includes a cammed upper surface having an upper portion disposed above a lower portion with an angled intermediate portion disposed therebetween; and a second hinge element rotatably received on the hinge pin between first and second positions and having a second cam member, wherein the second cam member includes a cammed lower surface that includes an engagement point that is engaged with the lower portion of the cammed upper surface of the first hinge element when the second hinge element is in the first position and the mullion assembly is in the stowed position, further wherein the engagement point is engaged with the upper portion of the cammed upper surface of the first hinge element when the second hinge element is in the second position and the mullion assembly is in the deployed position, and further wherein the mullion assembly is biased towards the stowed position from the deployed position.

2. The refrigerator of claim 1, including:

a spring member operably coupled between the second hinge element and the mullion assembly, wherein the spring member biases the second hinge element towards the first hinge element.

3. The refrigerator of claim 1, including:

a spring member operably coupled between the second hinge element and the mullion assembly, wherein the spring member biases the second hinge element towards the first position from the second position.

4. The refrigerator of claim 1, wherein the engagement point of the second hinge element defines a lowermost point of the cammed lower surface.

5. The refrigerator of claim 1, wherein the second hinge element moves upward along the hinge pin of the first hinge element as the second hinge element rotates from the first position to the second position.

6. The refrigerator of claim 5, wherein the angled intermediate portion of the cammed upper surface of the first hinge element is continuously angled in an upward direction from the lower portion of the cammed upper surface of the first hinge element to the upper portion of the cammed upper surface of the first hinge element.

7. The refrigerator of claim 6, wherein the lower portion of the cammed upper surface of the first hinge element is disposed within a crenulation defined on the cammed upper surface of the first hinge element.

8. The refrigerator of claim 1, wherein the second hinge element includes a mounting flange to fixedly couple the second hinge element to the mullion assembly for rotation therewith.

9. The refrigerator of claim 8, wherein the first hinge element includes a base portion to fixedly couple the first hinge element to the door, and further wherein the base portion is spaced-apart from the first cam member.

* * * * *